US005487450A

United States Patent [19]

Gerber

[11] Patent Number: 5,487,450

[45] Date of Patent: Jan. 30, 1996

[54] BRAKING APPARATUS AND METHOD FOR A RAIL-BOUND CARRIAGE OF AN INCLINED OR VERTICAL ELEVATOR

[75] Inventor: Hans Gerber, Surrey, Canada

[73] Assignee: Garaventa Holding A.G., Goldau, Switzerland

[21] Appl. No.: 294,651

[22] Filed: Aug. 23, 1994

[30] Foreign Application Priority Data

Aug. 24, 1993 [CH] Switzerland ..... 2510/93

[51] Int. Cl.[6] ..... B66B 5/04; B66B 5/12

[52] U.S. Cl. ..... 187/367; 187/361; 187/374; 187/246

[58] Field of Search ..... 187/351, 361, 187/365, 367, 368, 373, 374, 245, 246

[56] References Cited

U.S. PATENT DOCUMENTS

| | | | |
|---|---|---|---|
| 4,029,177 | 6/1977 | Fiss | 187/374 |
| 4,662,481 | 5/1987 | Morris et al. | 187/373 |
| 5,052,523 | 10/1991 | Ericson | 187/373 X |
| 5,377,786 | 1/1995 | Nakagawa | 187/373 X |

FOREIGN PATENT DOCUMENTS

| | | |
|---|---|---|
| 2506279 | 11/1982 | France . |
| 2826309 | 8/1979 | Germany . |

*Primary Examiner*—William E. Terrell
*Assistant Examiner*—Dean A. Reichard
*Attorney, Agent, or Firm*—Sughrue, Mion, Zinn, Macpeak & Seas

[57] ABSTRACT

An apparatus and method for braking a carriage which travels on rails of an inclined or vertical elevator. The elevator includes a cable driving device having cables connected to the carriage for moving the carriage along the rails. The carriage has a main frame assembly and a movable frame assembly, mounted to slide along the main frame assembly. The braking device comprises a cam disk assembly having eccentric disks rotatably mounted to the movable frame assembly and held in a first position at a predetermined distance away from a surface of each of the rails for frictionally engaging the rails when released from the first position. The cam disk assembly then causes a plurality of brake blocks of the brake device to engage frictionally the rails when the eccentric disks frictionally engage the rails. A first releasing device causes the eccentric disks to release from the first position and engage frictionally the rails when at least one of the cables breaks. Moreover, a second releasing device causes the eccentric disks to release from the first position and engage frictionally the rails when the carriage travels above a predetermined speed. Finally, at least one shock absorber damps relative movement between the movable frame assembly and the main frame assembly, when the brake blocks engage the rails, to stop movement of the carriage along the rails.

15 Claims, 5 Drawing Sheets

BRAKING APPARATUS AND METHOD FOR A RAIL-BOUND CARRIAGE OF AN INCLINED OR VERTICAL ELEVATOR

BACKGROUND OF THE INVENTION

1. Field of the Invention

The present invention relates to a braking apparatus, including a catch brake and an overspeed prevention device, for a rail-bound carriage of an inclined or vertical elevator.

2. Description of the Related Art

Conventional rail-bound inclined and vertical elevators are provided with catch brakes, in accordance with international standards, in order to bring the carriage or cage to a standstill during emergencies, such as when a cable breaks or the carriage or cage exceeds a maximum allowable travel speed. Primarily, friction brakes having friction linings which engage the rails are used as the catch brakes.

However, in these arrangements, the stopping distance between the grasping of the catching device and the ultimate stopping of the carriage cannot be clearly determined in advance, because it is a function of the instantaneous coefficient of friction at the rails. For example, the rails are made in general of structural steel having untreated surfaces and can become partially corroded or covered with ice, thus affecting the frictional coefficient. Elevators erected outside, in particular, suffer greatly from these problems.

Such inclined elevators also are used in buildings, for example, to transport freight. Blocking devices such as catch brakes and/or overspeed safety devices are also provided for these elevators. These blocking devices forcibly lock the rails, or alternatively, lock into the rail guide according to, for example, DE-GM 77 27 207, which describes a blocking and catching device with a spring prestressed eccentric as the cam disk which clamps the carriage against a braking block at the rail. Such blocking devices effect virtually no predictable stopping distance. Moreover, when they grasp the rail, this grasping is associated with corresponding long braking decelerations and undesired noise.

Another example of a conventional catch brake and overspeed safety for a rail-bound vertical elevator is described in DE-PS 119 240. In the apparatus described in that document, two rotatable eccentric disks, which are connected together by a shaft, are provided as the catching device. The eccentric disks act without sliding friction on the appropriate rail, and they press against a brake block to insure engagement. The axis of rotation of each eccentric disk is disposed at right angles to the direction of motion of the cage, and is braced via a spring or an hydraulic buffer against the cage frame.

In this conventional catch brake, the lift at the eccentric disk corresponds directly to the damping distance, which is at a right angle to the lift. The eccentric disk does not act on the rail, but rather, during the braking operation, rides on the rail. Therefore, the damping distance is quite short, so that the braking deceleration is correspondingly high as soon as the catching device grasps. Further, the slope of the curve of the eccentric disk must be small, so that its engagement with the rail remains within the range of self-locking friction.

Also, in such an arrangement, the damping distance can be less than the complete revolution of the eccentric disk. In addition, for this known arrangement, a spring is also suitable for damping the kinetic energy of the cage.

SUMMARY OF THE INVENTION

In contrast, an object of the invention is to provide a catch brake and/or an overspeed safety device for a rail-bound carriage of an inclined or vertical elevator with a damping distance that is totally independent of the catching device and can be suitably determined for a desired application.

To achieve this object, the invention provides a carriage having a catch brake and overspeed safety device attached to a slide frame that is movable along a main frame in the direction of motion of the carriage so that the catching device engages the rails. According to an embodiment of the invention, two eccentric disks are prestressed in an effective direction and engage, following their release, with the appropriate rail. The friction pairing between the eccentric and the rail is self-locking, so that the eccentric disks ride on the rails, without sliding, until the clearance at the brake block is overcome.

Thus, the slide frame is clamped to the rails, and the movement of main frame of the carriage and the platform is damped by a shock absorber. Hence, the greater the weight of the main frame and platform, the higher the braking force.

Depending on the load, speed and the damping force set at the shock absorber, a braking deceleration that corresponds to the damping distance of the shock absorber occurs until the carriage comes to a standstill. Hence, sliding friction at the rails does not occur, so that the desired stopping or damping distance can be suitably predetermined and measured independently of the surface state of the rails for the respective application of the elevator.

In addition, the eccentric disks are preferably prestressed by gravity weights which are attached to each eccentric, rather than a spring, because the catching device would not function if such a spring were to brake. Furthermore, without a spring, the spring force required for the releasing operation does not have to be adjusted.

In an embodiment of the present invention, the releasing device at each eccentric disk comprises one retreat bow, against whose abutment the related eccentric disk rests and during a normal travel is engaged. Two retreat bows are connected together so as not to rotate via a release shaft. An arbitrary release swivels with the release shaft and lifts both retreat bows simultaneously during an emergency. Thus, both eccentric disks always "snap in" simultaneously and the carriage is prevented in a reliable manner from continuing to travel.

As a first releasing device, an embodiment of the present invention provides a slack rope release. The slack rope release comprises a rocker, mounted on the main frame of the carriage, which can swivel about its center at a swivel joint. Two tension ropes engage with the swivel joint. Two push rods, which are mounted at the ends of the lever, swivel at swivel joints, and can engage the release shaft in order to release the catching and blocking device when one of the two tension cables breaks.

Independent of the first releasing device, an embodiment of the present invention provides, as the second releasing device, an overspeed safety device. The overspeed safety device comprises a sensor wheel, which is mounted on each rail and can be rotated at the slide frame, and at least one crescent fly weight, which can swivel at the sensor wheel.

The fly weight is spring-prestressed radially toward the inside and engages with a pin via a release lever. Furthermore, the fly weight can swivel at the release shaft in order to release the catching and blocking device when the carriage exceeds the allowable maximum speed. Preferably, the overspeed safety has two opposing fly weights, which are connected together by a coupler via two other swivel joints into a joint parallelogram, so that they can be moved only synchronously in the radial direction.

The two fly weights are disposed in a case ring, which is connected to the sensor wheel so as not to rotate and is closed with a cover on the side facing away from the sensor wheel. The cover has slots, which are penetrated by the pins rigidly attached to the fly weights. Thus, the rotating fly weights are enclosed so as to be protected on all sides by the case.

In an embodiment of the present invention, one end of at least one leaf spring is attached to the case ring of the speed limiting mechanism. The other end of the leaf spring prestresses the fly weights radially towards the inside. The case ring and leaf spring can be rotated between cover and sensor wheel in order to determine the release centrifugal force in the circumferential direction. Preferably, there are two opposing leaf springs, each of which acts on a related fly weight.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, of which.

DETAILED DESCRIPTION OF THE PREFERRED EMBODIMENTS

Figures 1A, 1B, 1C:
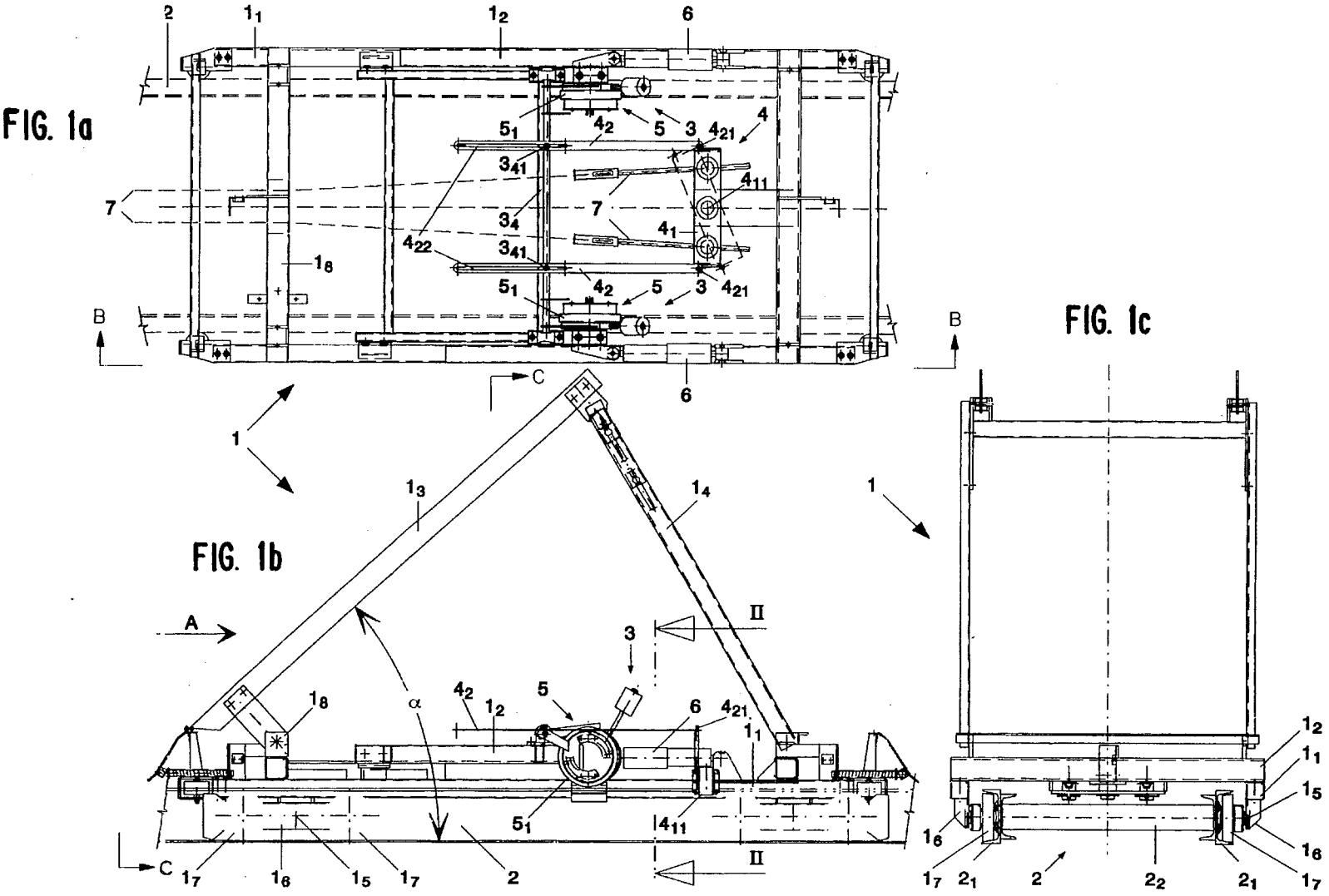
FIG. 1*a* is a top view of the carriage of a stationary inclined elevator according to an embodiment of the present invention.
FIG. 1*b* shows a side view of the carriage shown in FIG. 1*a* taken along lines B—B.
FIG. 1*c* illustrates a view of the carriage shown in FIG. 1*b* taken along lines C—C.

FIG. 1*a* shows a top view of a carriage 1 which travels along a rail system 2 of a stationary inclined elevator. Two tension cables 7 are attached to the carriage and wind about a cable winch (not shown) which therefore pulls the carriage along the rail system 2.

The carriage 1 comprises a main frame $\mathbf{1}_1$, on which, as shown in FIG. 1*b*, a platform $\mathbf{1}_3$ is mounted obliquely, at an angle having slope α, by a support $\mathbf{1}_4$. This angle α is equal or substantially equal to the angle of inclination α at which the rail system 2 runs with respect to the horizontal on a gradient, so that the platform $\mathbf{1}_3$, on which a cage (not shown) for passengers or the transport of freight is mounted, is thus horizontal.

The carriage 1 has at its main frame $\mathbf{1}_1$ two axes $\mathbf{1}_5$, at each of whose centers a two-armed rocker $\mathbf{1}_6$ can be swively mounted. As shown in FIG. 1*c*, two wheels $\mathbf{1}_7$ each are mounted on the ends of each rocker $\mathbf{1}_6$. The wheels $\mathbf{1}_7$ engage with the two channels $\mathbf{2}_1$ of the rail system 2. These two channels $\mathbf{2}_1$ are screwed to a box-shaped frame $\mathbf{2}_2$ and are braced against the foundations on the slope by bearings or the like (not shown).

A slide frame $\mathbf{1}_2$ is movable in direction of motion A along the main frame $\mathbf{1}_1$ of the carriage 1 and is braced against the main frame $\mathbf{1}_1$ by shock absorbers 6 attached to both sides. A braking device 3 is attached to the slide frame $\mathbf{1}_2$ above each rail $\mathbf{2}_1$ and is operable to engage with the rails $\mathbf{2}_1$ as controlled by two releasing devices 4 and 5, which act independently of each other.

Figure 2:
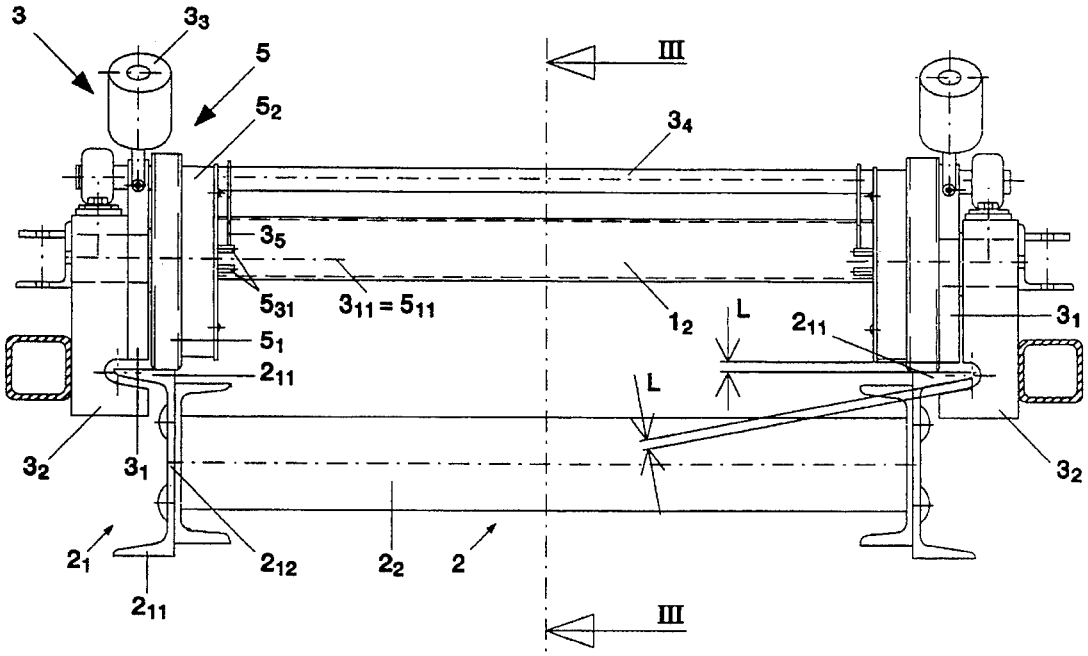
FIG. 2 is a sectional view taken along lines II—II in FIG. 1*b;*
Figure 3:
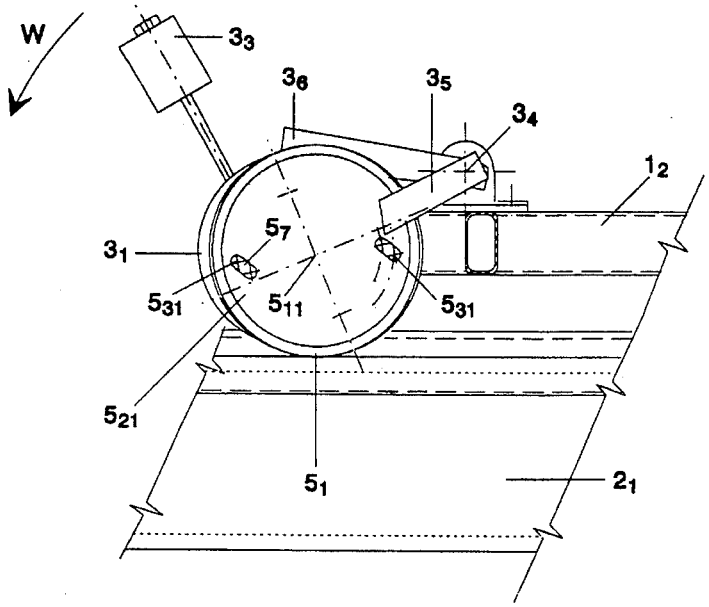
FIG. 3 is a sectional view taken along lines III—III in FIG. 2.

As shown in FIGS. 2 and 3, the braking device 3 comprises two eccentric disks $\mathbf{3}_1$, each which freely rotate above a corresponding rail $\mathbf{2}_1$ at the slide frame $\mathbf{1}_2$ around an axis $\mathbf{3}_{11}$, and are held at abutments (see FIG. 6*b*) of a retreat bow 3 (FIG. 1*b*). Each eccentric disk $\mathbf{3}_1$ is prestressed by a fly weight $\mathbf{3}_3$, rigidly attached to each eccentric disk, in its effective direction W to engage with its respective rail $\mathbf{2}_1$ and is situated, as long as the retreat bow $\mathbf{3}_6$ holds it at its abutment, at a certain distance above the upper leg $\mathbf{2}_{11}$ of the rail $\mathbf{2}_1$.

The active area of each eccentric disk $\mathbf{3}_1$ is formed by a curve, whose slope is designed to generate self-locking friction in its circumferential direction upon engagement with the upper leg $\mathbf{2}_{11}$ of its respective rail $\mathbf{2}_1$. A brake block 32, which is rigidly attached to the slide frame 1 and has a recess which envelops the upper leg $\mathbf{2}_{11}$ of its associated rail $\mathbf{2}_1$, ensures such engagement.

In the disengaged position shown in FIGS. 2 and 3, a certain clearance L with respect to each upper leg of the channel $\mathbf{2}_1$ is provided at both its associated eccentric disk $\mathbf{3}_1$ and brake block $\mathbf{3}_1$. Both retreat bows $\mathbf{3}_6$ are connected together by a release shaft $\mathbf{3}_4$ so as not to rotate. If the release shaft $\mathbf{3}_4$ is rotated, for example, by actuating the release lever $\mathbf{3}_5$, which is connected rigidly to the retreat bow $\mathbf{3}_6$ and the release shaft $\mathbf{3}_4$, then the retreat bows $\mathbf{3}_6$ disengage simultaneously or substantially simultaneously from their respective eccentric disk $\mathbf{3}_1$. Therefore, each gravity weight $\mathbf{3}_3$ rotates its associated eccentric disk 31 in its effective direction W to engage with the corresponding rail $\mathbf{2}_1$.

The two releasing devices act independently of each other and cause engagement of the braking devices 3 with their respective rails $\mathbf{2}_1$ in an emergency. For example, the slack rope release 4 is shown in FIG. 1*a*. Furthermore, an overspeed safety device 5 in each braking device 3 responds independently of the slack rope release 4 when the carriage 1 exceeds its predetermined maximum speed in the direction of motion A (downward), for example, if the cable winch brake fails.

The slack rope release 4, as shown in FIG. 1*a*, comprises a rocker $\mathbf{4}_1$ which is mounted on the main frame $\mathbf{1}_1$ and swivels in the center in the swivel joint $\mathbf{4}_{11}$. The two tension cables 7 act on the opposing levers of the rocker $\mathbf{4}_1$. Push rods $\mathbf{4}_2$ are mounted at both lever ends of the rocker $\mathbf{4}_1$ and swivel in the swivel joints $\mathbf{4}_{21}$.

The push rods each engage, via a slot $\mathbf{4}_{22}$, a corresponding pin $\mathbf{3}_{41}$ of the release shaft $\mathbf{3}_4$ of the braking device 3. The length of the slots $\mathbf{4}_{22}$ in the push rods $\mathbf{4}_2$ is adjusted to correspond suitably to the damping stroke D during the braking operation. Thus, if one of the two tension cables 7 breaks, the other taut cable 7 pulls the rocker $4_1$ into the swivelled position, which is shown by a dashed line in FIG. 1*a*, thus rotating the release shaft $3_4$ by its pins $3_{41}$ via the push rods $4_2$. Hence, the retreat bows $3_6$ are each forced to disengage their corresponding eccentric disk $3_1$, and the eccentric disks thereby $3_1$ grasp the rails $2_1$.

Figure 4B:
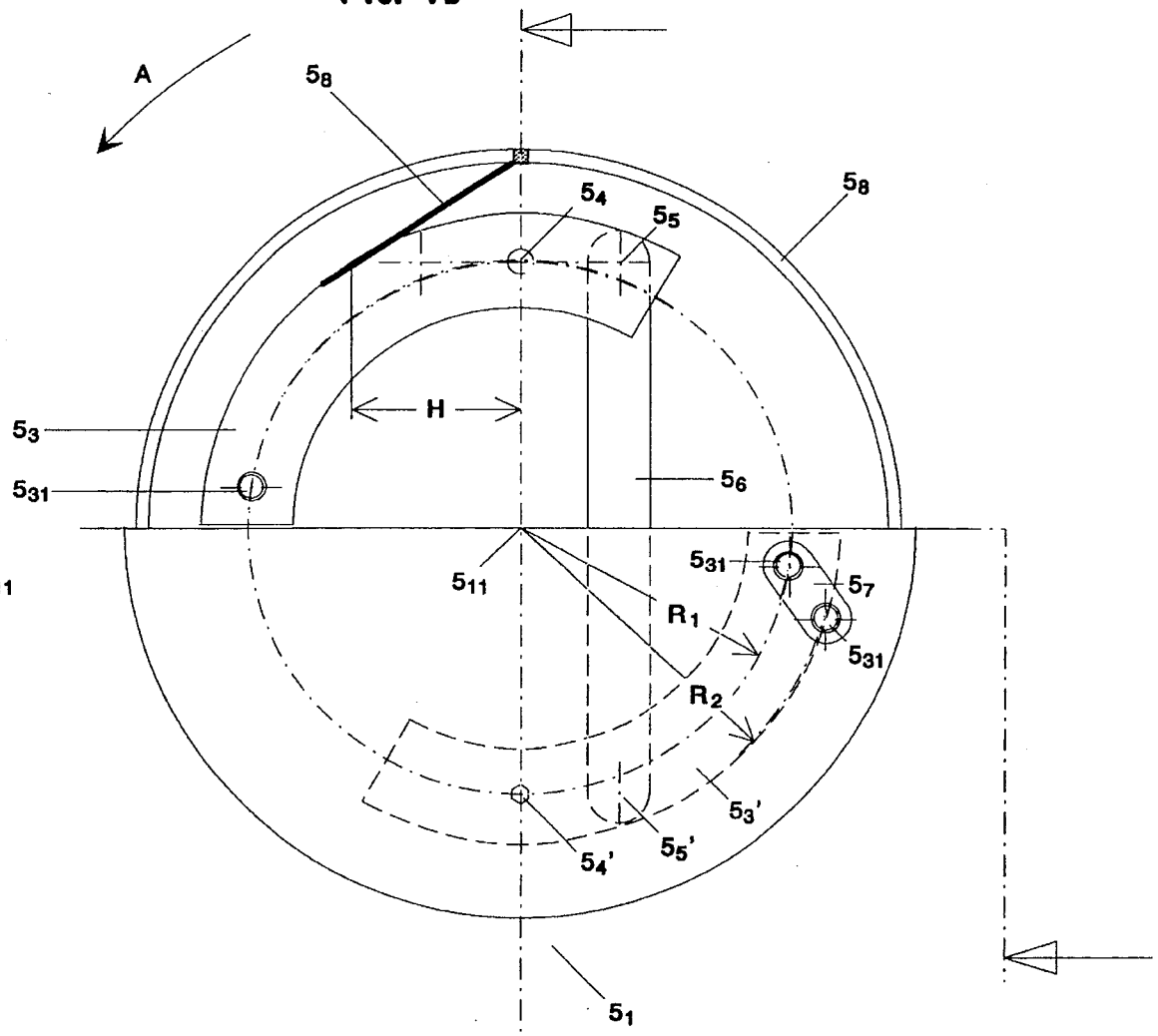
FIG. 4*b* illustrates a view of the overspeed safety device shown in FIG. 4*a* taken along lines B—B.
Figure 4A:
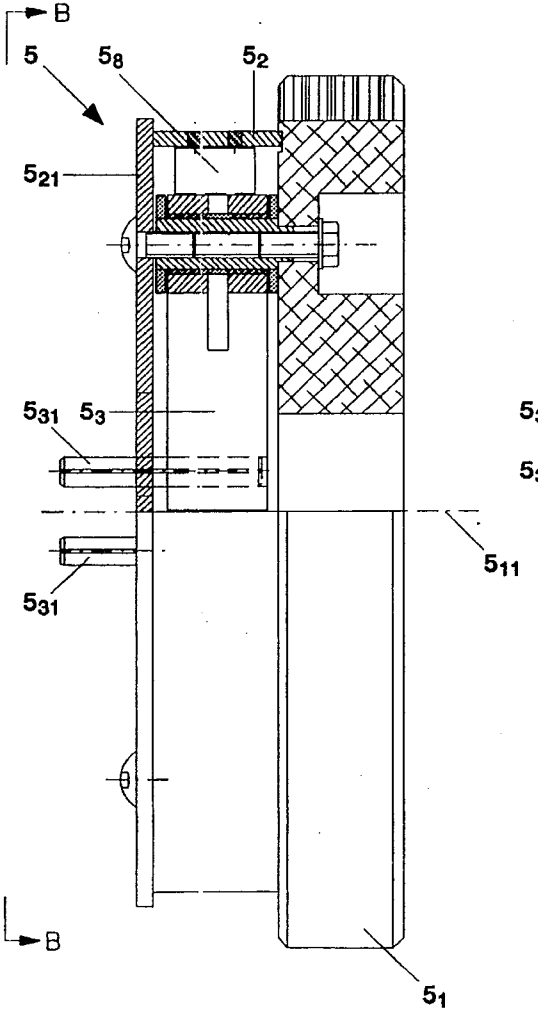
FIG. 4*a* shows an embodiment of an overspeed safety device according to the present invention.

The details of the overspeed safety device 5 are shown in FIGS. 4*a* and 4*b*. A sensor wheel $5_1$ freely rotates at each rail $2_1$ on a sensor wheel axis $5_{11}$. sensor wheel axis $5_{11}$ is mounted stationary to the slide frame $1_2$, is in coincidence with the eccentric disk rotation axis $3_{11}$, and rides under the load of the slide frame $1_2$ on the upper leg $2_{11}$ of the channel $2_1$ forming the rail. The direction of rotation of the sensor wheel $5_1$ is in the direction of downward motion A and thus is also denoted as A.

An annular case $5_2$ is rigidly connected to the sensor wheel $5_1$ and closed on its side with a case cover $5_{21}$. A centrifugal force-releasing device is located in the case $5_2$.

Two opposing crescent fly weights $5_3$ and $5_3$, are mounted to one end on the sensor wheel $5_1$ so as to swivel in swivel joints $5_4$ and have on their other end a rigid pin $5_{31}$. The rigid pin $5_{31}$ penetrates a sloped slot $5_7$ in the case cover $5_{21}$, as shown in FIG. 4*b*.

The two fly weights $5_3$, $5_3$, are connected substantially into a joint parallelogram via a coupler $5_6$ in two other swivel joints $5_5$, $5_5$, and thus always move synchronously relative to each other. The joint parallelogram with the swivel joints $5_4$-$5_5$-$5_5$,-$5_4$, is constructed in such a manner that the coupler acts on fly weight $5_3$ at swivel joint $5_5$ and acts on the other fly weight $5_3$, at swivel joint $5_5$,.

Two opposing leaf springs $5_8$ or the like are attached to the case ring $5_2$. The leaf springs press radially inwardly on the respective fly weights $5_3$ and $5_3$, with their contact point at the fly weight $5_3$ relative to the sensor wheel swivel joint $5_4$ defining a lever arm H. Thus, the fly weights $5_3$ and $5_3$, are prestressed in a defined manner. By rotating the case ring $5_2$ clamped between the case cover $5_{21}$ and the sensor wheel $5_1$, the effective length of the lever arm H can be modified. Hence, the release of centrifugal force and thus the maximum allowable speed of the carriage 1 can be defined in advance.

That is, when the speed of rotation allows the centrifugal force generated by the fly weights $5_3$ and $5_3$, to overcome the preset pre-stress force of both leaf springs $5_8$, the pins $5_{31}$, penetrating the case cover $5_{21}$ in the slot $5_7$, swivel from their radially internal abutment at a distance R1 to the axis of rotation $5_{11}$ radially outwardly and strike the other end of the slot $5_7$ at distance R2 from the axis of rotation $5_{11}$. Thus, the pins $5_{31}$ engage the release lever $3_5$ of the braking device 3, shown in FIG. 2 and 3, and release the retreat bow $3_6$.

The method by which the braking device 3 functions will now be explained in detail, together with the overspeed safety device 5, with reference to FIGS. 5*a–c* and corresponding FIGS. 6*a–c*. That is, the details relating to the carriage 1 are more apparent in FIGS. 5*a–5c*, whereas the details relating to the braking 3 and the release of the overspeed safety device 5 are more apparent in FIGS. 6*a–6c*.

The direction of travel for a direction of motion downward is denoted as A. The braking device 3 can be forced to engage with the rail system 2 in the effective direction W.

Figures 5A, 5B, 5C:
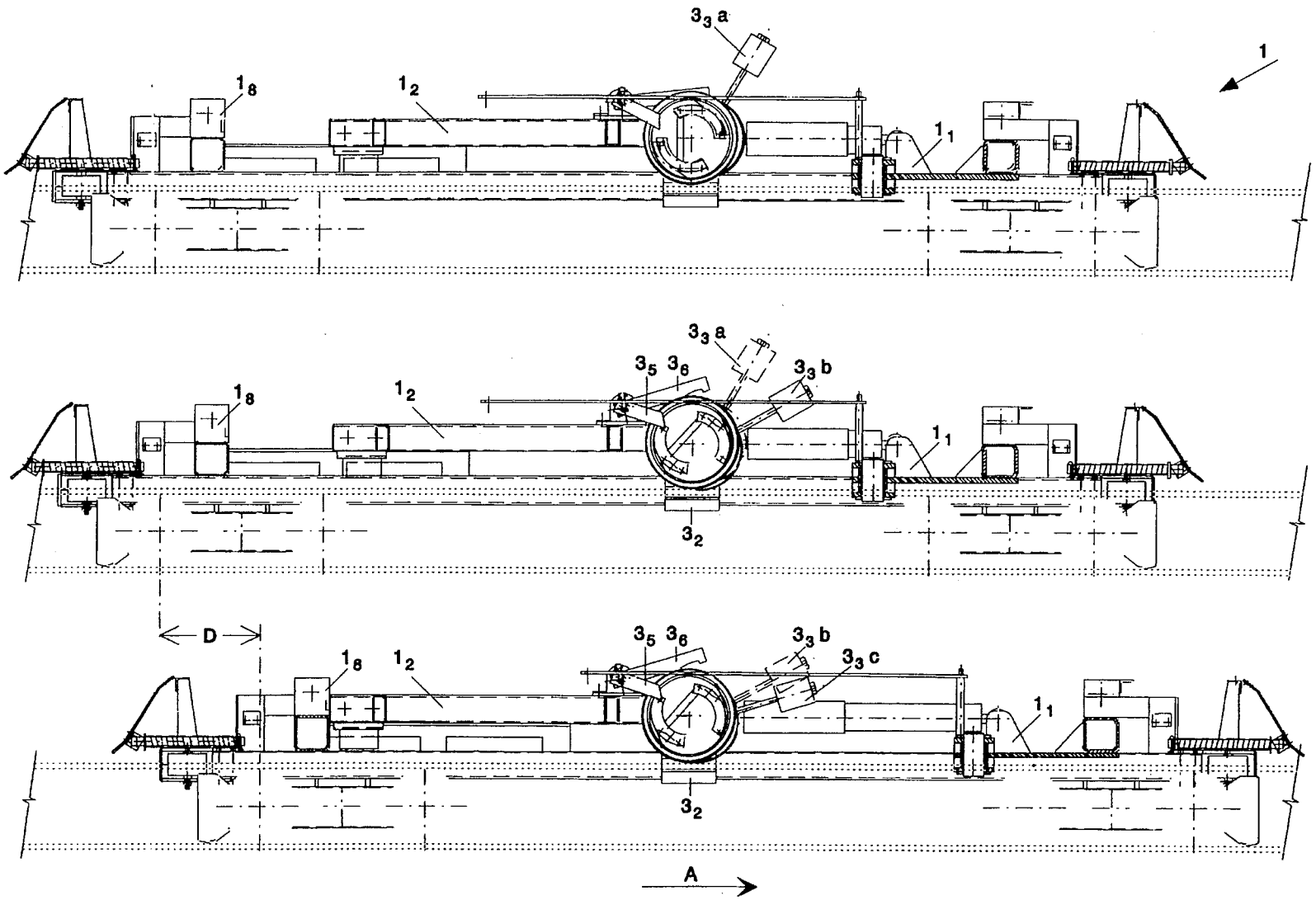
FIG. 5*a* shows a carriage of the embodiment of the present invention shown in FIG. 1*a;*
FIG. 5*b* illustrates the eccentric disk engaging with the rail.
FIG. 5*c* illustrates the eccentric disk braking the carriage to a standstill.
Figure 6A:
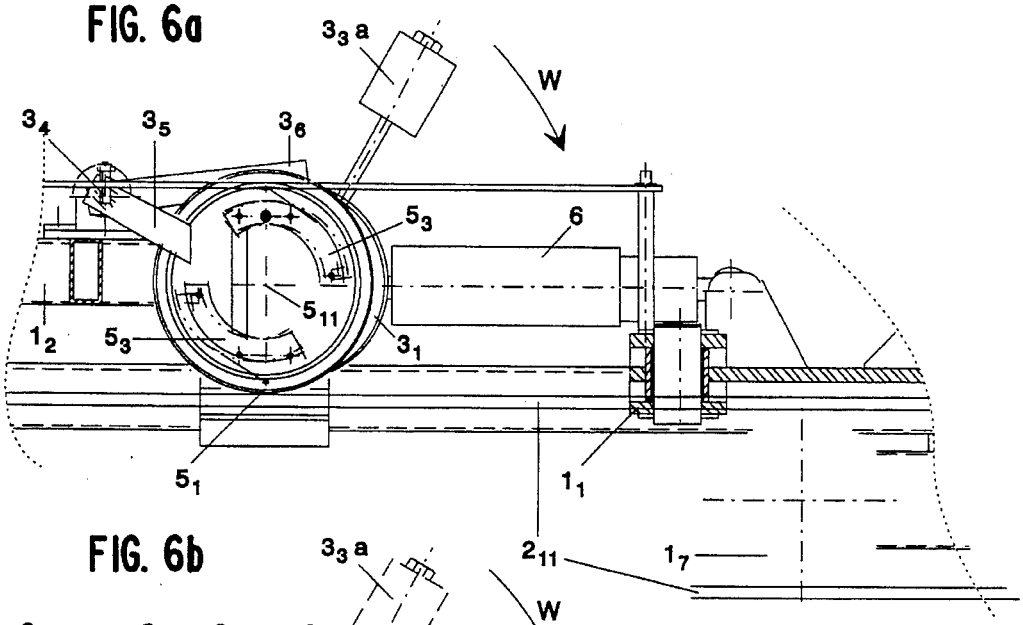
FIG. 6*a* shows an enlarged view of the eccentric disk of the carriage shown in FIG. 5*a;*

FIGS. 5*a* and 6*a* show the normal unengaged state. The sensor wheel $5_1$ rides under the load of the weight of the slide frame $1_2$ on the upper leg $2_{11}$ of the rail $2_1$, without sliding. The eccentric disk $3_1$ with gravity weight $3_3$ is held at the abutment $3_{61}$ (visible in FIG. 6*b*) of the retreat bow $3_6$ and is prestressed in the effective direction W by the gravity weight $3_3$. At normal speed, the fly weights $5_3$ are located, under the prestress induced by the leaf springs $5_8$, at their radially internal abutment R1 (see FIG. 4*b*), where their pins $5_{31}$ rotate around the axis $5_{11}$ without striking the release lever $3_5$. The shock absorber 6 is retracted in the illustrated normal state.

Figure 6B:
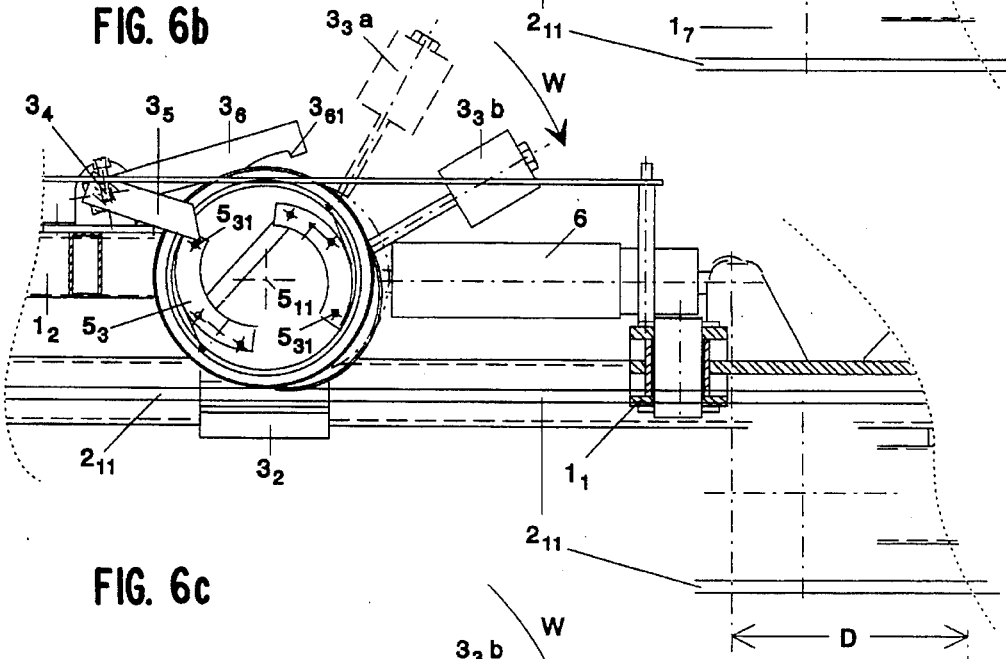
FIG. 6*b* illustrates an enlarged view of the eccentric disk engaging with the rail as shown in FIG. 5*b*.

According to FIGS. 5*b* and 6*b*, the carriage 1 has exceeded, for whatever reason, its maximum allowable speed, so that the release of the centrifugal force of the overspeed safety 5 overcomes the prestress of its leaf spring. Hence, the two fly weights $5_3$, guided as cranks of a joint parallelogram, swivel together with their pins $5_{31}$ radially outwardly and strike the radially external abutment R2 (as shown in FIG. 4*b*) in the slot $5_7$ of the case cover $5_{21}$. Thus, one of the two pins $5_{31}$ engages with the release lever $3_5$ and lifts the retreat bow $3_6$ by rotating the release shaft $3_4$.

The same event occurs at the eccentric disk $3_1$ located at the other rail $2_1$, since both releasing devices are connected together via the release shaft $3_4$ so as not to rotate independent of each other. The released gravity weights $3_3$ rotate the radially projecting part of the curve at the related eccentric disk $3_1$ out of the position (shown as position $3_3a$ in FIG. 6*a*), which is shown with a dashed line in FIG. 6*b*, in the direction of the arrow W into the position $3_3b$, which is shown with a solid line in FIG. 6*b* and during which the eccentric disk $3_1$ makes contact with the upper leg $2_{11}$ of the rail $2_1$.

Figure 6C:
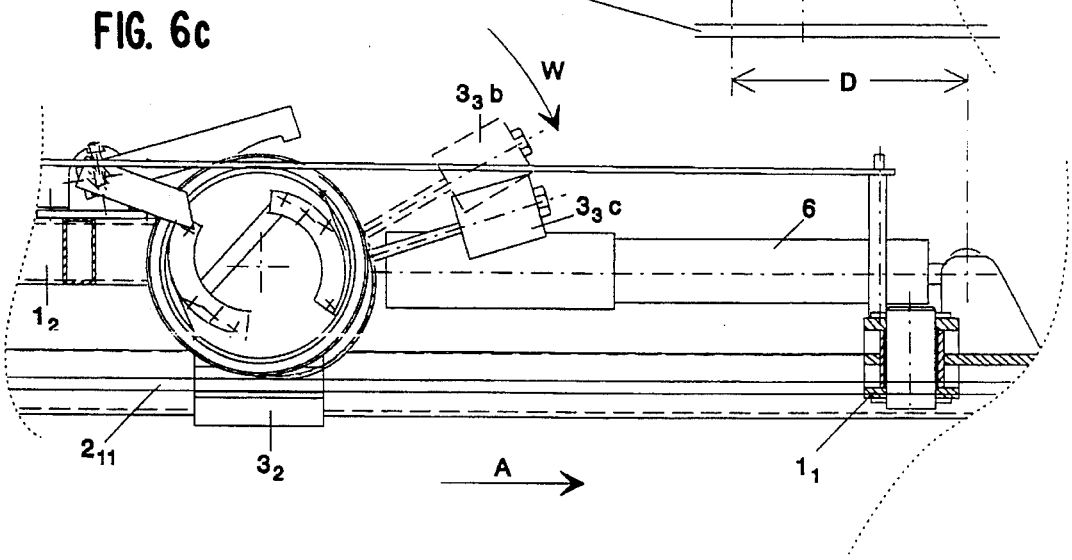
FIG. 6*c* illustrates an enlarged view of the eccentric disk braking the carriage to a standstill as shown in FIG. 5*c*.

After the eccentric disk $3_1$ has made force-locking contact with the upper leg $2_{11}$ of the rail $2_1$, its curve rides, according to FIGS. 5*c* and 6*c*, from the position of the gravity weight $3_3b$ shown in FIG. 6*b* (which is shown as a dashed line in FIG. 6*c*) to the position $3_3c$, which is shown as a solid line in FIG. 6*c*, without sliding. This occurs because the friction pairing between the rail $2_1$ and eccentric disk $3_1$ is designed for self-locking friction, and continues until the clearance L (see FIG. 2) between brake block $3_2$ and the bottom area at the upper leg $2_{11}$ of the rail $2_1$ is overcome and thus, the counteractive area at the brake block $3_2$ rests force-lockingly against the upper leg $2_{11}$ of the rail $2_1$.

In the position $3_3c$ of the gravity weight $3_3$, the motion of slide frame $1_2$ of the carriage 1 is stopped due to this engagement of the brake block $3_2$ with the rail $2_1$, so that now the actual braking operation starts. That is, the main frame $1_1$ of the carriage 1 runs against the shock absorber 6 disposed between slide frame $1_2$ and main frame $1_1$ and is shifted relative to the slide frame $1_2$ in the direction of motion A, so that the shock absorber 6 damps its motion.

The maximum damping and braking distance is denoted as D in FIGS. 5*b–c* and 6*b–c* and can be measured in a suitable manner for the respective application through the design of related components.

In addition, an end buffer $1_8$ is mounted on the main frame $1_1$. Hence, the slide frame $1_2$ can strike against the end buffer if the carriage 1 is overloaded.

When the slack rope release 4 catches, the braking device 3 acts in an analogous manner. In this case, the rotation of the release shaft $3_4$ to lift the retreat bow $3_6$ is initiated by the push rod $4_2$ of the slack rope release 4.

After remedying the cause of the trouble, the eccentric disks $3_1$ of the braking device 3 can be untwisted from the rails $2_1$ with the aid of the cable winch and suspended again from the related retreat bow $3_6$. Hence, the carriage 1 will be again ready to move.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A braking apparatus for a carriage which travels on rails of an inclined or vertical elevator, said elevator including a cable driving device having cables connected to the carriage for moving the carriage along the rails, said carriage having a main frame assembly and a movable frame assembly slidably mounted to said main frame assembly, said braking apparatus comprising:

a cam disk assembly, rotatably mounted to said movable frame assembly and having eccentric disks releasibly held in a first position at a predetermined distance away from a surface of each of said rails for frictionally engaging said rails when released from said first position;

a plurality of brake blocks, said cam disk assembly causing said brake blocks to engage frictionally said rails when said eccentric disks frictionally engage said rails;

a releasing device for causing said eccentric disks to release from said first position and engage frictionally said rails when at least one of the following occurs:
at least one of said cables breaks; and
said carriage travels above a predetermined speed; and at least one shock absorber for damping relative movement between said movable frame assembly and said main frame assembly, when said brake blocks engage said rails, to stop movement of said carriage along said rails.

2. A braking apparatus as claimed in claim 1, further comprising gravity weights for exerting a predetermined force on said eccentric disks when said eccentric disks are held in said first position.

3. A braking apparatus as claimed in claim 1, wherein:

each of said eccentric disks correspond to one of said rails; and said braking apparatus further comprises a pair of segments, coupled together by a release shaft and rotatably mounted to said movable frame, each for releasibly engaging with one of said eccentric disks to releasibly hold said eccentric disks in said first position.

4. A braking apparatus as claimed in claim 3, wherein said releasing device comprises a slack rope release, comprising:

a rocker, swively mounted to said main frame and to which said cables are connected;

push rods, swively coupled to said rocker, for engaging said release shaft when one of said cables breaks to cause said segments to disengage said eccentric disks to cause said eccentric disks to engage frictionally said rails.

5. A braking apparatus as claimed in claim 3, wherein said releasing device comprises a plurality of sensor wheels, rotatably mounted to said movable frame and each corresponding to one of said eccentric disks, each of said sensor wheels comprising:

at least one crescent fly weight, swively mounted to said sensor wheel;

a spring for forcing each said at least one crescent fly weight radially inward toward an axis of rotation of said sensor wheel;

said at least one crescent fly weight having a pin and overcoming a force of said spring to move radially outward from said axis of rotation of said sensor wheel when said sensor wheel rotates at a predetermined speed to enable said pin to engage with one of said segments, to cause said segments to disengage said eccentric disks to cause said eccentric disks to engage frictionally said rails.

6. A braking apparatus as claimed in claim 5, wherein each of said sensor wheels comprises two of said fly weights, connected together by a coupler via two swivel joints to form a joint parallelogram so that said two of said fly weights move synchronously in a radial direction of said sensor wheel.

7. A braking apparatus as claimed in claim 6, wherein each of said sensor wheels comprises a case ring connected thereto, said two fly weights are disposed in said case ring, said case ring has slots therein through which said pins protrude.

8. A braking apparatus as claimed in claim 7, wherein an end of said spring is attached to the case ring and another end of said leaf spring presses said fly weights radially toward said axis of rotation of said sensor wheel.

9. A braking apparatus as claimed in claim 8, wherein each said sensor wheel comprises two of said springs, each for forcing said at least one crescent fly weight radially inward toward an axis of rotation of said sensor wheel.

10. A braking apparatus for a carriage which travels on rails of an inclined or vertical elevator, said elevator including a cable driving device having cables connected to the carriage for moving the carriage along the rails, said carriage having a main frame assembly and a movable frame assembly slidably mounted to said main frame assembly, said braking apparatus comprising:

first means, rotatably mounted to said movable frame assembly and being releasibly held in a first position at a predetermined distance away from a surface of each of said rails, for frictionally engaging said rails when released from said first position;

second means for, based on a position of said cam disk assembly, frictionally engaging said rails when said first means frictionally engages said rails;

means for causing said first engaging means to release from said first position and engage frictionally said rails when at least one of the following occurs:
at least one of said cables breaks; and
said carriage travels above a predetermined speed; and means for damping relative movement between said movable frame assembly and said main frame assembly, when said second engaging means engages said rails, to stop movement of said carriage along said rails.

11. A braking apparatus as claimed in claim 10, further comprising means for exerting a predetermined force on said first engaging means when said first engaging means is held in said first position.

12. A braking device as claimed in claim 10, further comprising holding means, rotatably mounted to said movable frame, for releasibly engaging with said first engaging means to releasibly hold said first engaging means in said first position.

13. A braking device as claimed in claim 12, wherein said causing means comprises:

means, swively mounted to said main frame, for securing said cables to said main frame;

means, swively coupled to said securing means, for engaging said holding means when one of said cables breaks to cause said holding means to disengage said first engaging means to cause said first engaging means to engage frictionally said rails.

14. A braking apparatus as claimed in claim 12, wherein said causing means comprises:

means for rolling along said rails;

means, swively mounted to said rolling means, for moving radially outward from an axis of rotation of said rolling means, when said rolling means rotates at a predetermined speed, to engage with said holding means to cause said holding means to disengage said first engaging means to cause said first engaging means to engage frictionally said rails.

15. A method for braking a carriage which travels on rails of an inclined or vertical elevator, said elevator including a cable driving device having cables connected to the carriage for moving the carriage along the rails, said carriage having a main frame assembly, a movable frame assembly slidably mounted to said main frame assembly, a cam disk assembly rotatably mounted to said movable frame assembly and having rotatable eccentric disks, and a plurality of brake blocks, said method comprising the steps of:

causing said eccentric disks to engage frictionally said rails when said carriage travels above a predetermined speed or at least one of said cables breaks;

causing said brake blocks to engage frictionally said rails substantially immediately after causing said eccentric disks to engage frictionally said rails; and damping relative movement between said movable frame assembly and said main frame assembly, when said brake blocks engage said rails, to stop movement of said carriage along said rails.

* * * * *